United States Patent [19]

Masuda et al.

[11] 4,283,697

[45] Aug. 11, 1981

[54] HIGH FREQUENCY FILTER

[75] Inventors: Yoshio Masuda; Atsushi Fukasawa; Jun Ashiwa; Takuro Sato, all of Tokyo, Japan

[73] Assignee: Oki Electric Industry Co., Ltd., Tokyo, Japan

[21] Appl. No.: 92,670

[22] Filed: Nov. 9, 1979

[30] Foreign Application Priority Data

Nov. 20, 1978 [JP] Japan ..... 53-142306

[51] Int. Cl.[3] ..... H01P 1/20; H01P 7/00

[52] U.S. Cl. ..... 333/202; 333/203; 333/219

[58] Field of Search ..... 333/202–207, 333/219–226, 245

[56] References Cited

U.S. PATENT DOCUMENTS 4,179,673 12/1979 Nishikawa et al. ..... 333/204

*Primary Examiner*—Marvin L. Nussbaum

*Attorney, Agent, or Firm*—Armstrong, Nikaido, Marmelstein & Kubovcik

[57] ABSTRACT

A high frequency filter for frequencies higher than the VHF band comprises a closed conductive housing, a pair of input and/or output means like an antenna provided at both the extreme ends of said housing, a plurality of resonators arranged on a straight line between said antennas, each of said resonators having an elongated inner conductor and a cylindrical dielectric body surrounding said inner conductor, one end of each of said resonators being fixed on the single plane of the housing and the other end of each of said resonators being free standing, and the length between each of the resonators being defined according to the specified coupling coefficient for the desired characteristics of the filter.

The present filter utilizes the coupling effect between resonators by the displacement current relating to surface TM mode and the conductive current relating to TEM mode. Therefore, no coupling means for providing the coupling between resonators is provided.

7 Claims, 15 Drawing Figures

HIGH FREQUENCY FILTER

BACKGROUND OF THE INVENTION

The present invention relates to a high frequency filter, in particular, relates to a novel filter of dielectric waveguide type, which is suitable for use especially in the range from the VHF bands to the comparatively low frequency microwave bands.

First, three prior filters for the use of said frequency bands will be described.

FIG. 1 shows the perspective view of a conventional interdigital filter, which has been widely utilized in the VHF bands and the low frequency microwave bands. In the figure, the reference numerals 1-1 through 1-5 are resonating rods which are made of conductive material, 2-1 through 2-4 are gaps between adjacent resonating rods, and 3 is a case. 3-1 through 3-3 are conductive walls of said case 3. A cover 3-4 of the case 3 is not shown for the sake of the simplicity of the drawing. A pair of exciting antennas 4 are provided for the connection of the filter to an external circuit. The length of each of the illustrated resonating rods 1-1 through 1-5 is selected as to be substantially equivalent to one quarter of a wavelength, and one end of the resonating rods are short-circuited alternately to the confronting conductive walls 3-1 and 3-2, while the opposite ends thereof are free standing.

However, said interdigital filter has the disadvantage that each of the resonating rods is fixed alternately to the confronting two conductive walls, in order to obtain the enough coupling coefficient between each resonating rods, and so, the manufacture of the filter is cumbersome and subsequently the filter is costly. If each of the resonating rods were mounted on a single wall, the coupling between each of the resonating rods would not be enough and the characteristics of a filter would not be satisfactory.

Now, the theoretical analysis that the coupling between each of the resonators would be insufficient if the resonators were arranged in line on the single conductive side wall, will be described below in accordance with FIGS. 2(A) through 2(C) and FIG. 3.

In realizing a high frequency filter with an excellent electric characteristic, it is very important how to build up coupling between adjacent resonators. More specifically, however high Q, or a small loss the resonators or, a loss in the coupling means between resonators results in an increase in the filter loss. Accordingly, it has been practice to provide the coupling between resonating rods by air gaps made by suitably spacing the resonating rods as shown in FIG. 1. However, if the resonating rods should be fixed to the single bottom surface 3-1, the coupling between the adjacent resonators would be very small, and a filter with a desired band width could not be obtained.

In FIGS. 2(A) through 2(C), solid line arrows and dotted line arrows represent vectors of electric field and magnetic field of high frequency, respectively. FIG. 2(A) is a horizontal sectional view of FIG. 1 on the conditions that one of the ends of the resonating rods 1-1 and 1-2 are short-circuited to the single conductive bottom surface 3-1, and FIGS. 2(B) and 2(C) are vertical sectional views. In the figures, 3-3 and 3-4 show upper and lower bottom surfaces, as in the case of FIG. 1.

Now, the coupling between the resonating rods 1-1 and 1-2 will be analyzed by separately taking the magnetic coupling and the electric coupling. It should be noted that the electric field and the magnetic field in FIGS. 2(A) through 2(C) are TEM mode.

Concerning the magnetic coupling, $\phi_1$ is the high-frequency magnetic flux around the resonating rod 1-1, and $I_{1\phi}$ is a high-frequency current accompanied by said flux $\phi_1$. The directions of $\phi_1$ and $I_{1\phi}$ are as shown in the figures. The flux $\phi_2$ induced around the resonating rod 1-2 by the flux $\phi_1$ can have two directions. The first direction is shown in FIG. 2(A) wherein $\phi_1$ and $\phi_2$ cancel each other in the gap 2-1, resulting that the flux of $\phi=\phi_1=\phi_2$ surrounds both the resonating rods 1-1 and 1-2 as shown in FIG. 2(B). In this case it should be noted that an electric current $I_{2\phi}$ flows in the resonating rod 1-2 in the direction as shown in the drawing, due to the flux $\phi$. Thus, the magnetic coupling is performed as shown in FIG. 2(B) with the coupling coefficient $k_\phi$. The second direction of $\phi$ which is induced on the resonating rod 1-2 by the flux $\phi_1$ is the case that the flux $\phi_2$ is in the opposite direction of FIG. 2(A), and in this case, both the fluxes $\phi_1$ and $\phi_2$ exist in the gap 2-1 as shown in FIG. 2(C), and there is no coupling between $\phi_1$ and $\phi_2$ in case of FIG. 2(C).

Then, the electric field coupling will be analyzed. $E_1$ is the high-frequency electric field emanating from the surface of the resonating rod 1-1, and $I_{1E}$ is a high-frequency electric current accompanied by the electric field $E_1$. The directions of $E_1$ and $I_{1E}$ are shown in the figures. The electric field $E_2$ induced on the surface of the resonating rod 1-2 by the electric field $E_1$ can have two directions. The first direction is shown in FIG. 2(A) wherein $E_1$ and $E_2$ are mutually continuous in the gap 2-1, resulting in that the electric field $E=E_1=E_2$ surrounds both of the resonating rods 1-1 and 1-2 as shown in FIG. 2(C). In this case, it should be noted that an electric current $I_{2E}$ flows in the resonating rod 1-2 in the direction as shown in the figure, due to the electric field E. Thus, the electrical coupling is accomplished as shown in FIG. 2(C) with the coupling coefficient $k_E$. The second direction of $E_2$ induced on the resonating rod 1-2 by the electric field $E_1$ is the case that the field $E_2$ is in the opposite direction of FIG. 2(A), and in this case, there exists an electric field as shown in FIG. 2(B), and there is no coupling between the electric fields $E_1$ and $E_2$.

The aforesaid four combinations are not mutually independent, due to the nature of the electromagnetic field, and can be summarized into two quantities, namely, the magnetic field coupling $k_\phi$ shown in FIG. 2(B) and the electric field coupling $k_E$ shown in FIG. 2(C).

Now, attention is paid to the direction of currents in FIG. 2(A). More particularly, the directions of $I_{1\phi}$ and $I_{1E}$ are the same with each other, and the direction of $I_{2\phi}$ is opposite to that of $I_{2E}$. Accordingly, the amount of the coupling $k_{12}$ between the resonating rods 1-1 and 1-2 can be expressed by;

$$k_{12}=|k_\phi-k_E| \quad (1)$$

Thus, the relations among $k_{12}$, $k_\phi$ and $k_E$ can be defined by the formula (1). The variation of $k_{12}$ with the distance (x) between the resonating rods 1-1 and 1-2 is shown in FIG. 3. This is due to the fact that both $k_\phi$ and $k_E$ monotonously decreases with the distance (x) on the principle of electromagnetics. However, since the coupling between resonators in FIGS. 2(A) through 2(C) is accomplished by TEM mode (Transverse Electric Magnetic mode), the absolute value of the coupling coefficient is very small, and further, since the coupling coefficient $k_{12}$ decreases with the distance (x), said distance (x) must be very small for obtaining a sufficient coupling coefficient for a practical filter. However, in an actual filter, said distance (x) can not be small enough to provide the sufficient coupling coefficient, and so a filter in which resonators are arranged on a single conductive wall can not be embodied, instead, resonators have been arranged interdigitally as shown in FIG. 1.

FIG. 4 shows the perspective view of another conventional filter, which is a comb-line type filter, and has been utilized in the VHF bands and the low frequency microwave bands. In the figure, the reference numerals 11-1 through 11-5 are conductive resonating rods with one of the ends thereof left free standing while opposite ends thereof are short-circuited to the conductive wall 13-1 of a conductive case 13. The length of each resonating rod 11-1 through 11-5 is selected to be a little shorter than a quarter of a wavelength. The resonating rod acts as inductance (L), and capacitance (C) is provided at the head of each resonating rod for providing the resonating condition. In the embodiment, said capacitance is accomplished by the disks 11a-1 through 11a-5 and the conductive bottom wall 13-2 of the case 13. The gaps 12-1 through 12-4 between each of the resonating rods provides the necessary coupling between each of the resonating rods. A pair of antennas 14 are provided for the connection between the filter and external circuits.

With this type of filter, the resonating rods 11-1 through 11-5 are fixed on the single bottom wall 13-1 and the manufacturing cost can be reduced as far as this point is concerned, but there is the shortcoming in that the manufacture of the capacitance (C) with an accuracy of, for instance, several %, is rather difficult, resulting in no cost merit. Therefore, the advantage of a comb-line type filter is merely that it can be made smaller than an interdigital filter.

FIG. 5 shows a perspective view of a conventional dielectric filter. In the figure, 21-1 through 21-5 are dielectric resonators each of which has a suitable thickness with the cross sectional dimensions usually selected for satisfying resonating conditions, while the length of each resonator is determined by considering such factors as unloaded $Q_u$, and/or a spurious characteristics. The resonators 21-1 through 21-5 are fixed on a dielectric plate 23-1 which has a small dielectric constant and placed in a shielding case 23. The gaps 22-1 through 22-4 are provided between the resonators in order to achieve the desired degree of coupling between adjacent resonators. Also, a pair of exciting antennas 24 are provided for the coupling of the filter with an external circuit.

However, this type of filter has the shortcoming in that the size of each resonator is rather large even when the dielectric constant of the material of the resonators is as large as possible. Therefore, it is hardly practical for actual application of this filter in the VHF bands and the low frequency microwave bands.

SUMMARY OF THE INVENTION

It is an object, therefore, of the present invention to overcome the disadvantages and limitations of a prior high frequency filter by providing a new and improved high frequency filter.

It is also an object of the present invention to provide a high frequency filter in which all of the resonators are fixed on the single plane, and no coupling means is provided between resonators.

The above and other objects are attained by a high frequency filter comprising a closed conductive housing, a pair of input/output means provided at both the extreme ends of said housing, a plurality of resonators mounted in said housing on a straight line between said input/output means, one end of all said resonators being fixed at the single conductive plane of said housing, the other end of said resonators being free standing, each of said resonators having a center conductor and a dielectric body surrounding said center conductor, an air gap being provided between adjacent resonators and between a resonator of an extreme end and said input/output means, the width of said air gap being determined according to the desired coupling coefficient for the filter, and the coupling between each of the resonators being accomplished by the displacement current relating to surface TM mode and the conductive current relating to TEM mode.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 6:
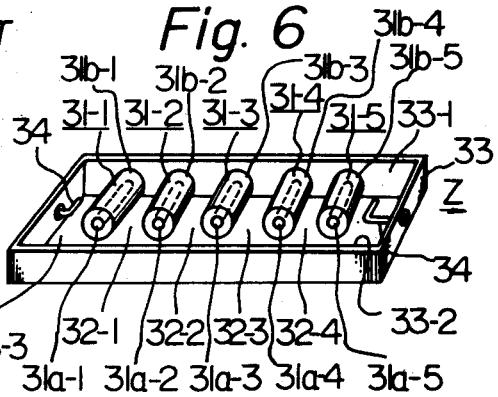
FIG. 6 shows the structure of the high frequency filter according to the present invention.

FIG. 6 shows an embodiment of a high-frequency filter according to the present invention, which has five resonators. In the figure, 31-1 through 31-5 are resonators, and conductors 31a-1 through 31a-5 are inserted into the centers of the resonators 31-1 through 31-5, respectively. The dielectric bodies 31b-1 through 31b-5 surround the center conductors 31a-1 through 31a-5, respectively. The cross section of the dielectric body and the center conductor is circular in the embodiment. However, it should be appreciated that the cross section is not limited to the circular, but any shape of the cross section is possible in the present invention. The length of each resonator is selected to be about one quarter wavelength, and one end of the conductors 31a-1 through 31a-5 are short-circuited to the single bottom surface 33-1 of the conductive case 33, while the opposite ends thereof are free standing with a sufficient spacing from another bottom surface 33-2 of the conductive case 33. In order to couple the adjacent resonators, air gaps 32-1 through 32-4 of suitable spacing are provided therebetween, and antennas 34 are provided for coupling the extreme end resonators to an external circuit. Also, 33-3 is a lower bottom conductive surface of the case, 33-4 is a top surface (not shown), therefore, the case 33 is completely closed by conductive walls and the inner surface of the case 33 forms a cut-off waveguide for shielding for Z direction propagation, so that the construction represents a cut-off waveguide with resonators disposed therein at predetermined gaps therebetween.

It should be appreciated in FIG. 6 that each resonators have a center conductor and a dielectric body surrounding said center conductor, and no means is provided between each of the resonators for increasing the coupling coefficient, except an air gap. Those two structures are important features of the present invention.

Now, the operation of the present filter will be described below.

Figure 7A:
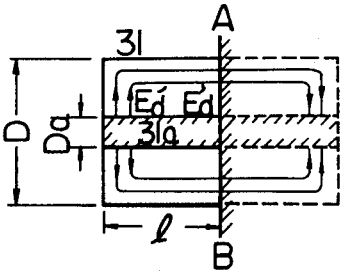
FIG. 7(A) and FIG. 7(B) show the sectional views of the one resonator of the filter shown in FIG. 6.
Figure 7B:
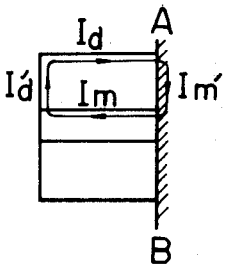

FIG. 7(A) and FIG. 7(B) show horizontal sectional views of one resonator in the filter of FIG. 6. In FIG. 7(A), (D) is the diameter of the cylindrical dielectric body surrounding the center conductor, $D_a$ is the diameter of the center conductor inserted in said dielectric body, and (l) is the length of the resonator. The resonating condition of the resonator is as follows.

$$\left.\begin{aligned} l &= \tfrac{1}{4}\lambda_g \\ \lambda_g &= \frac{1}{\sqrt{\epsilon_r}}\lambda_o \\ \lambda_o &= \frac{C}{f} \end{aligned}\right\} \quad (2)$$

where C is a light velocity, $\lambda_o$ is the wavelength in the free space, $\lambda_g$ is the wavelength in the resonators in the longitudinal direction of the resonators, $\epsilon_r$ is the effective dielectric constant of the resonators. $\epsilon_r$ is usually different from the dielectric constant of the material of the dielectric body of a resonator itself, since the present resonator is the combination of the center conductor and the surrounding dielectric body. For instance in the embodiment, when the dielectric constant of the dielectric body itself is $\epsilon_{rO}=20$, the effective dielectric constant $\epsilon_r$ is 10. And (f) is the resonating frequency. Also, the line AB shows a short-circuiting plane for the quarterwavelength resonators using a conductive wall. If the conductive wall providing the line AB does not exist, the right-hand side of FIG. 7(A) acts additionally, resulting in an operation as a half wavelength resonator of the length 2l.

FIG. 7(A) shows the electric field. In the figure, $E_d$ is the component of the electric field in the longitudinal direction of the resonator, and $E_d'$ is the perpendicular component of said electric field. FIG. 7(B) shows the electric current, and $I_m$ is the current on the surface of the center conductor, $I_m'$ is the current on the conductive wall AB, $I_d$ is the Maxwell displacement current corresponding to the current $E_d$, and $I_d'$ is the Maxwell displacement current corresponding to the current $E_d'$.

In order to prevent that an electric field leaks outside the dielectric body, the valve (D) is preferably four times as large as the value ($D_a$).

Figure 8:
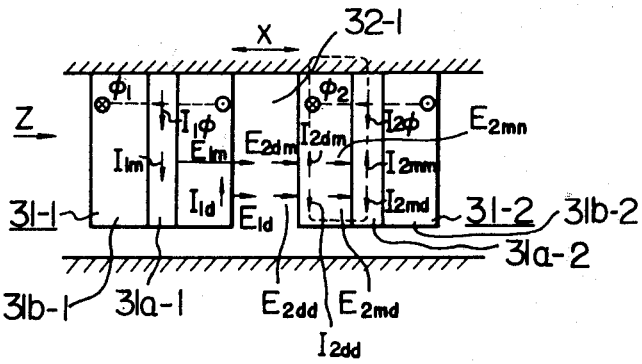
FIG. 8 shows the electric field and the magnetic field in the present filter.

FIG. 8 shows the electric field and the magnetic field when a pair of quarter wavelength resonators 31-1 and 31-2 each having a center conductor and dielectric body surrounding the center conductor, are disposed in parallel but with a gap 32-1 therebetween in a cut off waveguide.

It should be noted in FIG. 8 that the mode of the electric field and the magnetic flux is the so-called coupling mode which is the combination of TEM mode (Transverse Electric-Magnetic mode), and the surface TE mode, due to the presence of the displacement current in the dielectric body surrounding the center conductor, while the mode of a prior filter is merely TEM mode.

In FIG. 8, the symbols indicate as follows.

$\phi_1$; high frequency magnetic flux around the center conductor 31a-1, $I_{1\phi}$; the current in the center conductor 31a-1 induced by the flux $\phi_1$. The directions of $I_{1\phi}$ and $\phi_1$ are shown in the drawing, $\phi_2$; the magnetic flux induced around the center conductor 31a-2 by said flux $\phi_1$, $I_{2\phi}$; the current in the center conductor 31a-2 induced by the flux $\phi_2$. The directions of $\phi_2$ and $I_{2\phi}$ is shown in the drawing.

$E_{1m}$; the high frequency electric field emanated from the surface of the center conductor 31a-1, $I_{1m}$; the current in the center conductor 31a-1 induced by the electric field $E_{1m}$, $E_{1d}$; the high frequency electric field emanated from the dielectric body 31b-1, $I_{1d}$; the current on the surface of the dielectric body 31b-1 induced by the electric field $E_{1d}$, $E_{2mm}$; the electric field induced on the center conductor 31a-2 by the electric field $E_{1m}$, $I_{2}$mm; the current in the center conductor 31a-2 by the electric current $E_{2mm}$, $E_{2dm}$; the electric field on the surface of the dielectric body 31b-2 by the electric field $E_{1m}$, $I_{2dm}$; the current on the surface of the dielectric body 31b-2 by the electric field $E_{2dm}$, $E_{2md}$; the electric field in the center conductor 31a-2 by the electric field $E_{1d}$, $I_{2md}$; the current in the center conductor 31a-2 by the electric field $E_{2md}$, $E_{2dd}$; the electric field on the surface of the dielectric body 31b-2 induced by the electric current $E_{1d}$, $I_{2dd}$; the displacement current on the dielectric body 31b-2 induced by the electric field $E_{2dd}$.

Concerning the direction of the electric current $I_{2\phi}$, $I_{2mm}$, $I_{2md}$, $I_{2dd}$, and $I_{2dm}$ it should be appreciated that the clockwise direction along the dotted loop is supposed to be positive, and the counter clockwise direction along the dotted loop is supposed to be negative.

Also, it should be appreciated that the coupling coefficient $k_{12}$ between the first resonator 31-1 and the second resonator 31-2 is the algebrical sum of $k_\phi$, $k_{Edm}$, $k_{Emd}$, $k_{Emm}$ and $k_{Edd}$, where $k_\phi$ is the coupling coefficient by the magnetic flux between the fluxes $\phi_1$ and $\phi_2$, $k_{Edm}$ is the coupling coefficient by the electric field between the center conductor 31a-1 and the dielectric body 31b-2, $k_{Emd}$ is the coupling coefficient by the electric field between the dielectric body 31b-1 and the center conductor 31a-2, $k_{Emm}$ is the coupling coefficient by the electric field between the center conductor 31a-1 and the center conductor 31a-2, and $k_{Edd}$ is the coupling coefficient by the electric field between the dielectric body 31b-1 and the dielectric body 31b-2.

Figure 1:
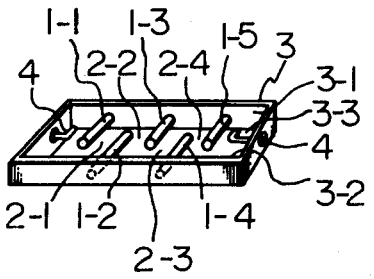
Fig. 1 PRIOR ART
FIG. 1 shows the structure of a prior high frequency filter.
Figure 2A:
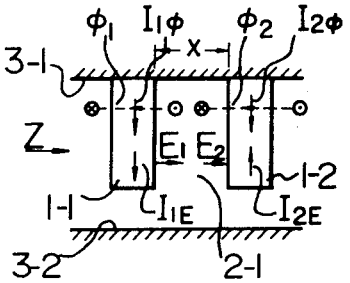
Fig. 2(A) PRIOR ART
FIG. 2(A), FIG. 2(B) and FIG. 2(C) show the electric field and the magnetic field in the prior filter.
Figure 2B:
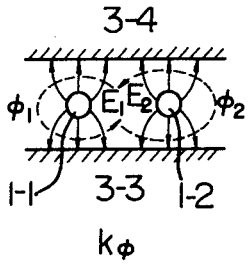
Fig. 2(B) PRIOR ART
Figure 2C:
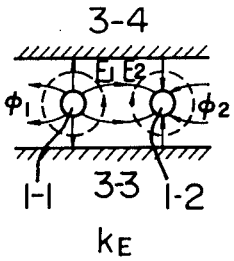
Fig. 2(C) PRIOR ART

From the comparison of FIGS. 2(A) through 2(C), with FIG. 8, the followings are apparent.

(a) The coupling coefficient $k_\phi$ by the magnetic flux between the fluxes $\phi_1$ and $\phi_2$ is the same as the case shown in FIG. 2(B). That is to say, the coupling by the magnetic flux is not affected by the presence of the dielectric bodies.

(b) The electrical coupling $k_{Emm}$ between the electrical field $E_{1m}$ on the center conductor 31a-1 and the electrical field $E_{2mm}$ on the center conductor 31a-2, and the electrical coupling $k_{Edm}$ between the electrical field on the center conductor 31a-1 and the electric field on the surface of the dielectric body 31b-2 are provided, similar to the electrical coupling shown in FIG. 2(C). In this case, the direction of $I_{2mm}$ induced by the electrical field $E_{2mm}$ is opposite to that of $I_{2dm}$ induced by the electrical field $E_{2dm}$, and the direction of $I_{2mm}$ is opposite to that of $I_{2\phi}$, as shown in FIG. 8. Accordingly, the sign of $k_{Emm}$ is different from the sign of $k_{Edm}$, and the sign of $k_{Emm}$ is different from the sign of $k_\phi$.

(c) The electrical coupling $k_{Emd}$ between the electrical field $E_{1d}$ on the surface of the dielectric body 31b-1 and the electrical field $E_{2md}$ on the center conductor 31a-2, and the electrical coupling $k_{Edd}$ between the electrical field $E_{1D}$ on the surface of the dielectric body 31b-1 and the electrical field $E_{2dd}$ on the surface of the dielectric body 31b-2 are also provided, similar to the electrical coupling shown in FIG. 2(C). In this case, the direction of $I_{2md}$ induced by the electrical field $E_{2md}$ is opposite to that of $I_{2dd}$ induced by the electrical field $E_{2dd}$, and the direction of $I_{2md}$ is the same as that of $I_{2\phi}$, as shown in FIG. 8. Accordingly, the sign of $k_{Emd}$ is different from the sign of $k_{Edd}$, and the sign of $k_{Emd}$ is the same as the sign of $k_\phi$.

Accordingly, what have the same signs as that of $k_\phi$ are;

$K_\phi$, $k_{Edm}$, $k_{Emd}$ and what have the opposite signs to that of $k_\phi$ are;

$k_{Emm}$, and $k_{Edd}$.

As a result, the total amount of the coupling $k_{12}$ between the resonators 31-1 and 31-2 is given as follows.

$$k_{12}=|(k_\phi+k_{Edm}+k_{Emd})-(k_{Emm}+k_{Edd})| \quad (3)$$

The followings can be concluded from the formula (3).

(a) When the distance (x) between two resonators is sufficiently small ($x\rightarrow 0$), $k_\phi >> k_{Edm}$, $k_\Phi >> k_{Emd}$, and $k_{Edd} >> k_{Emm}$ are satisfied. The $k_{Edm}$, $k_{Emd}$ and $k_{Emm}$ are sufficiently small since the length between two center conductors, and/or one conductor and the surface of the dielectric body is larger than the length between the surfaces of the dielectric bodies of two resonators. The $k_{Edd}$ is large since the length between the surfaces of the two dielectric bodies is small in this case, and $k_\phi$ is large since the magnetic coupling is accomplished as shown in FIG. 2(B). Therefore, the formula (3) is changed to;

$$k_{12}=|k_\phi-k_{Edd}| \quad (3a)$$

Further, $k_\phi \approx k_{Edd}$ is satisfied since those two values are close to each maximum value when the distance (x) is close to zero. Accordingly, as (x) is close to zero ($x=0$), the value $k_{12}$ is close to zero ($k_{12}\approx 0$).

(b) When (x) is smaller than the predetermined value, both $k_\phi$ and $k_{Edd}$ decreases with the increase of the value (x), and in this case $k_{Edd}$ decreases faster than $k_\phi$ for the same change of (x). Accordingly, when the value (x) increases within said predetermined value, the value $k_{12}$ increases.

This characteristics are explained theoretically as follows. The gap 32-1 in FIG. 8 is considered to be a cut-off waveguide, and the couplings $k_\phi$ and $k_{Edd}$ are considered to be produced by TE wave (H wave), and TM wave (E wave), respectively. For instance in the case of a rectangular waveguide with a height-width ratio of 1:2, the attenuation constants for each mode have the following relationship.

$$\alpha_{TE10}<\alpha_{TE01}<\alpha TE20<\alpha_{TE11}=\alpha_{TM11}$$

where $\alpha$TE10, $\alpha_{TE01}$, $\alpha_{TE20}$, $\alpha_{TE11}$ and $\alpha$TM11 are the attenuation constants of $TE_{10}$, $TE_{01}$, $TE_{20}$, $TE_{11}$ and $TM_{11}$ modes. Therefore, it should be noted that the attenuation constant of TE wave including the high order modes, are considerably smaller than those of TM modes. This fact leads to the conclusion (b).

(c) When the value (x) exceeds the predetermined value ($x_0$), the absolute values of $k_\phi$ and $k_{Edd}$ become small. Accordingly, when the value (x) increases in the range that (x) is larger than ($x_0$), the coupling coefficient $k_{12}$ becomes small.

Figure 9:
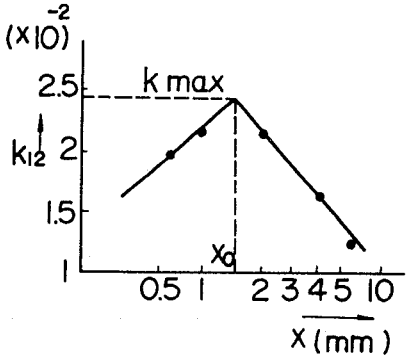
FIG. 9 shows the curve between the length (x) between a pair of resonators, and the coupling coefficient ($k_{12}$) of the present filter.

FIG. 9 shows the experimental result of the value of the coupling coefficient $k_{12}$ under the conditions that $D=15$ mm, $D_a=4$ mm, $l=26$ mm, the effective specific dielectric constant $\epsilon_r$ of the dielectric body is substantially $\epsilon_r=10$, and the inside dimension of the shielding conductive case is $15\times 32$ ($mm^2$).

As can be seen from FIG. 9, the maximum value $k_{max}$ of the coupling coefficient is obtained when the gap length between resonators is properly designed. The maximum value $k_{max}$ depends upon the dimensions of various portions and the dielectric constant $\epsilon_r$.

Accordingly, the desired coupling coefficient can be obtained by properly desinging the gap length (x) between each of the individual resonators. In general, the resonators at either extreme end require the largest coupling coefficient.

It should be appreciated in FIG. 9 that the characteristics having the maximum coupling coefficient $k_{max}$ when the distance (x) is not zero is the important feature of the present invention. The characteristics are obtained because of the presence of the specific structure of the resonator having dielectric body surrounding the center conductor. If there is no dielectric body surrounding the center conductor, and the resonator is composed of only a conductor, the characteristics between the distance and the coupling coefficient are shown in FIG. 3.

Figure 3:
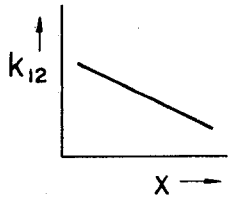
Fig. 3 PRIOR ART
FIG. 3 shows the curve between the length (x) between a pair of resonators, and the coupling coefficient ($k_{12}$) of the prior filter.
Figure 4:
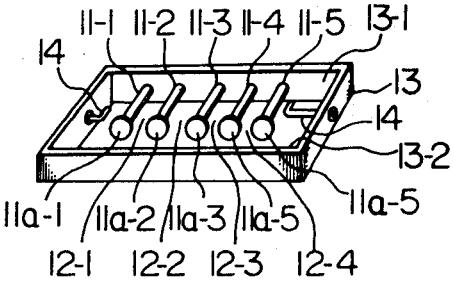
Fig. 4 PRIOR ART
FIG. 4 shows the structure of another prior high frequency filter.
Figure 5:
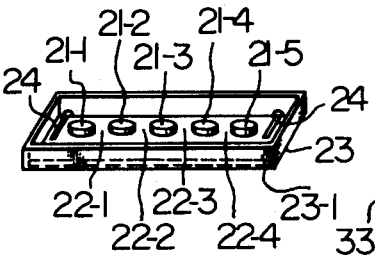
Fig. 5 PRIOR ART
FIG. 5 shows the structure of still another prior high frequency filter.

Further, the absolute value of said $k_{max}$ is considerably larger than that of the case of FIG. 3, since the coupling between two resonators is accomplished not only be TEM mode but also by the surface TM mode.

Taking into consideration the necessary value of the coupling coefficient $k_{12}$ required for ordinary filters, it is possible to select the range of the value of (x) from 0.5 mm to 3.0 mm. Accordingly, the gap length (x) is small and negligible as compared with the length of the resonators (the length in Z direction of FIGS. 6 and 8). Thus, it should be understood that the present invention is very effective in miniaturizing a filter. Further, since it is sufficient to provide small gaps between resonators for the coupling of the resonators, and no coupling means is provided, the insertion loss due to the coupling means does not exists.

By the way, when the coupling coefficient must be finely adjusted, a coupling control means is provided between resonators.

Figure 10:
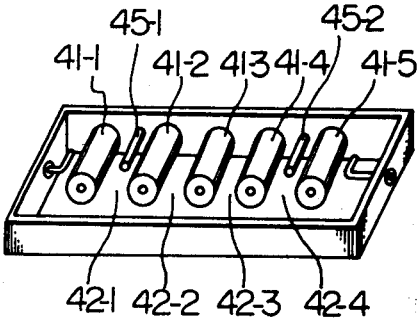
FIG. 10 is the structure of the modification of the present filter.

FIG. 10 shows the modification of the present filter, having said coupling control means. In FIG. 10, dielectric rods 45-1 and 45-2 are provided between resonators 41-1 and 41-2, and between the resonators 41-4 and 41-5, respectively in order to increase the coupling coefficient. The remaining gaps 42-2 and 42-3 have no coupling control means. Said dielectric rods 45-1 and 45-2 are disposed parallel to the resonators.

Figure 11:
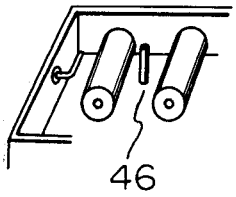
FIG. 11 shows the structure of another modification of the present filter.

FIG. 11 shows the conductor 46 as coupling control means between resonators for increasing the coupling coefficient. In this case, the conductor 46 is disposed perpendicular to the resonators.

Figure 12:
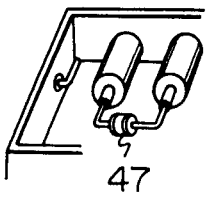
FIG. 12 shows the structure of still another modification of the present filter.

FIG. 12 shows another modification for increasing the coupling coefficient. In FIG. 12, the center conductors of the adjacent resonators are connected to each other by a capacitor 47.

Although the cross section of the dielectric body and the center conductor is circular for the sake of the easy explanation, it should be appreciated that said cross section can be in any other shape.

As described in the foregoing, the present invention provides the high-frequency filter with a simple structure and excellent characteristics, by using resonators consisting of a center conductor and a dielectric body surrounding the center body. The couplings between resonators, and between resonators and external circuits are obtained by a properly designed air gap. Although the foregoing explanation referred to resonators of quarter wavelength, numerous modifications such as the use of resonators of half wavelength and/or the use of a different coupling control means are possible.

From the foregoing it will now be apparent that a new and improved high frequency filter has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A high frequency filter comprising a closed conductive housing, a pair of input/output means provided at both the extreme ends of said housing, a plurality of resonators mounted in said housing on a straight line between said input/output means, and one end of all of said resonators being fixed on the single conductive plane of said housing and the other end of said resonators being free standing, wherein each resonator comprises a center conductor and a dielectric body surrounding said center conductor, and wherein the outer surface of the dielectric body is substantially disposed in the air so that a displacement current on the surface of the dielectric body can flow, the separation between each of said resonators is determined according to the desired coupling coefficient for the filter, and the coupling between each resonators is effected by the displacement current relating to surface TM mode and the conductive current relating to TEM mode.

2. A high frequency filter according to claim 1, further comprising an auxiliary coupling control means provided in the separation between at least two of said resonators.

3. A high frequency filter according to claim 2, wherein said auxiliary coupling control means is a dielectric rod disposed parallel to said resonators and one end of said rod is fixed on said conductive plane.

4. A high frequency filter according to claim 2, wherein said auxiliary coupling control means is a conductive rod disposed perpendicular to said resonators.

5. A high frequency filter according to claim 1, wherein the separation between said resonators is in the range from 0.5 mm to 3.0 mm.

6. A high frequency filter according to claim 1, wherein the length of each said resonator is one quarter wavelength.

7. A high frequency filter according to claim 1, wherein the length of each said resonator is half wavelength.

* * * * *